US011488515B2

(12) United States Patent
Seo

(10) Patent No.: US 11,488,515 B2
(45) Date of Patent: Nov. 1, 2022

(54) FOLDABLE DISPLAY DEVICE

(71) Applicant: LG Display Co., Ltd., Seoul (KR)

(72) Inventor: JungMin Seo, Uiwang-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/119,768

(22) Filed: Dec. 11, 2020

(65) Prior Publication Data

US 2021/0201754 A1 Jul. 1, 2021

(30) Foreign Application Priority Data

Dec. 26, 2019 (KR) ..... 10-2019-0175315

(51) Int. Cl.
*G09G 3/20* (2006.01)

(52) U.S. Cl.
CPC ..... *G09G 3/2092* (2013.01); *G09G 2310/027* (2013.01); *G09G 2320/0276* (2013.01); *G09G 2320/0673* (2013.01); *G09G 2380/02* (2013.01)

(58) Field of Classification Search
CPC ..... G09G 3/2092; G09G 2310/027; G09G 2320/0276; G09G 2320/0673; G09G 2380/02; G09G 3/035; G09G 2300/0426; G09G 2320/0233; G09G 2330/028; G09G 3/20; G09G 3/2077; G06F 3/1423; G09F 9/301; H04N 5/202
See application file for complete search history.

(56) References Cited

U.S. PATENT DOCUMENTS

| | | | | |
|---|---|---|---|---|
| 10,520,978 | B1 | 12/2019 | Li et al. | |
| 2014/0078190 | A1* | 3/2014 | Wu | H05K 1/147 29/831 |
| 2015/0009240 | A1* | 1/2015 | Matsuoka | G09G 3/3291 345/83 |
| 2015/0177552 | A1* | 6/2015 | Syu | G09G 3/36 349/149 |
| 2016/0313846 | A1 | 10/2016 | Hong et al. | |
| 2018/0061344 | A1 | 3/2018 | Kurokawa | |
| 2018/0097197 | A1 | 4/2018 | Han et al. | |
| 2021/0183293 | A1* | 6/2021 | Piao | G09G 3/20 |

FOREIGN PATENT DOCUMENTS

| | | | |
|---|---|---|---|
| CN | 1719310 | A | 1/2006 |
| CN | 108766249 | A | 11/2018 |
| CN | 108877535 | A | 11/2018 |
| CN | 109584806 | A | 4/2019 |
| CN | 109727540 | A | 5/2019 |
| KR | 10-2017-0018196 | A | 2/2017 |

* cited by examiner

*Primary Examiner* — Roberto W Flores
(74) *Attorney, Agent, or Firm* — Seed IP Law Group LLP

(57) ABSTRACT

A foldable display device includes a display panel. The display panel includes a plurality of display areas divided by at least one or more folding lines. A plurality of data integrated circuits is configured to output a data voltage to the plurality of display areas. Each of the plurality of data integrated circuits includes at least one or more gamma voltage generators that are configured to output a plurality of gamma voltages. The at least one or more gamma voltage generators are connected by an external gamma line, so that boundaries between the display areas may be minimized or reduced.

19 Claims, 6 Drawing Sheets

FOLDABLE DISPLAY DEVICE

CROSS-REFERENCE TO RELATED APPLICATIONS

This application claims the priority benefit of Korean Patent Application No. 10-2019-0175315 filed on Dec. 26, 2019, in the Korean Intellectual Property Office, the disclosure of which is incorporated herein by reference.

BACKGROUND

Technical Field

The present disclosure relates to a foldable display device, and more particularly, to a foldable display device capable of driving a plurality of separated display areas.

Description of the Related Art

Display devices used for a computer monitor, a TV, and a mobile phone include an electroluminescence display device that emits light by itself, a liquid-crystal display (LCD) device that requires a separate light source, and the like.

Such display devices are being applied to more and more various fields including not only a computer monitor and a TV, but personal mobile devices, and thus, display devices having a wide display area and reduced volume and weight are being studied.

Recently, a foldable display device that can be freely folded and unfolded by forming a display unit, lines, and the like on a flexible substrate has attracted attention as a next-generation display device.

BRIEF SUMMARY

A foldable display device includes a display panel having flexibility so that it is foldable, and a plurality of data integrated circuits (D-IC) for driving the display panel. When folding the foldable display device, a display area may be separated into a plurality of display areas by the folding, and the plurality of separated display areas may be driven by different data integrated circuits. However, when the plurality of separated display areas output a single image as a whole, there occurs a problem in which a certain boundary is recognized, in boundaries between the separated display areas.

Accordingly, the inventors of the present disclosure have recognized that a structure and method capable of removing boundaries between display areas in a foldable display device is beneficial.

Thus, the inventors of the present disclosure have invented a foldable display device in which a boundary between display areas separated by at least one or more folding lines is not formed.

In various embodiments, the present disclosure provides a foldable display device capable of minimizing or reducing a deviation of data voltages output from a plurality of data integrated circuits.

Objects of the present disclosure are not limited to the above-mentioned objects, and other objects, which are not mentioned above, can be clearly understood by those skilled in the art from the following descriptions.

According one or more embodiments of the present disclosure, a foldable display device includes a display panel including a plurality of display areas divided by at least one or more folding lines; and a plurality of data integrated circuits outputting a data voltage to the plurality of display areas respectively, wherein each of the plurality of data integrated circuits includes at least one or more gamma voltage generators outputting a plurality of gamma voltages, wherein the at least one or more gamma voltage generators are connected by an external gamma line, so that boundaries between the display areas may be minimized or reduced.

Other detailed matters of the exemplary embodiments are included in the detailed description and the drawings.

According to one or more embodiments of the present disclosure, a plurality of gamma voltage generators receive gamma reference voltages applied from a single gamma reference voltage divider, whereby a deviation of gamma voltages output from the plurality of gamma voltage generators can be minimized or reduced.

According to one or more embodiments of the present disclosure, gamma reference voltages, resistance drops of which are equal to each other, are applied to a plurality of data integrated circuits. Thus, even when a plurality of display areas are driven using a plurality of data integrated circuits, a luminance deviation between the plurality of display areas may be reduced, thereby minimizing or reducing boundaries between the plurality of display areas.

The effects according to the present disclosure are not limited to the contents exemplified above, and more various effects are included in the present specification.

BRIEF DESCRIPTION OF THE SEVERAL VIEWS OF THE DRAWINGS

The above and other aspects, features and other advantages of the present disclosure will be more clearly understood from the following detailed description taken in conjunction with the accompanying drawings, in which.

DETAILED DESCRIPTION

Figure 1:
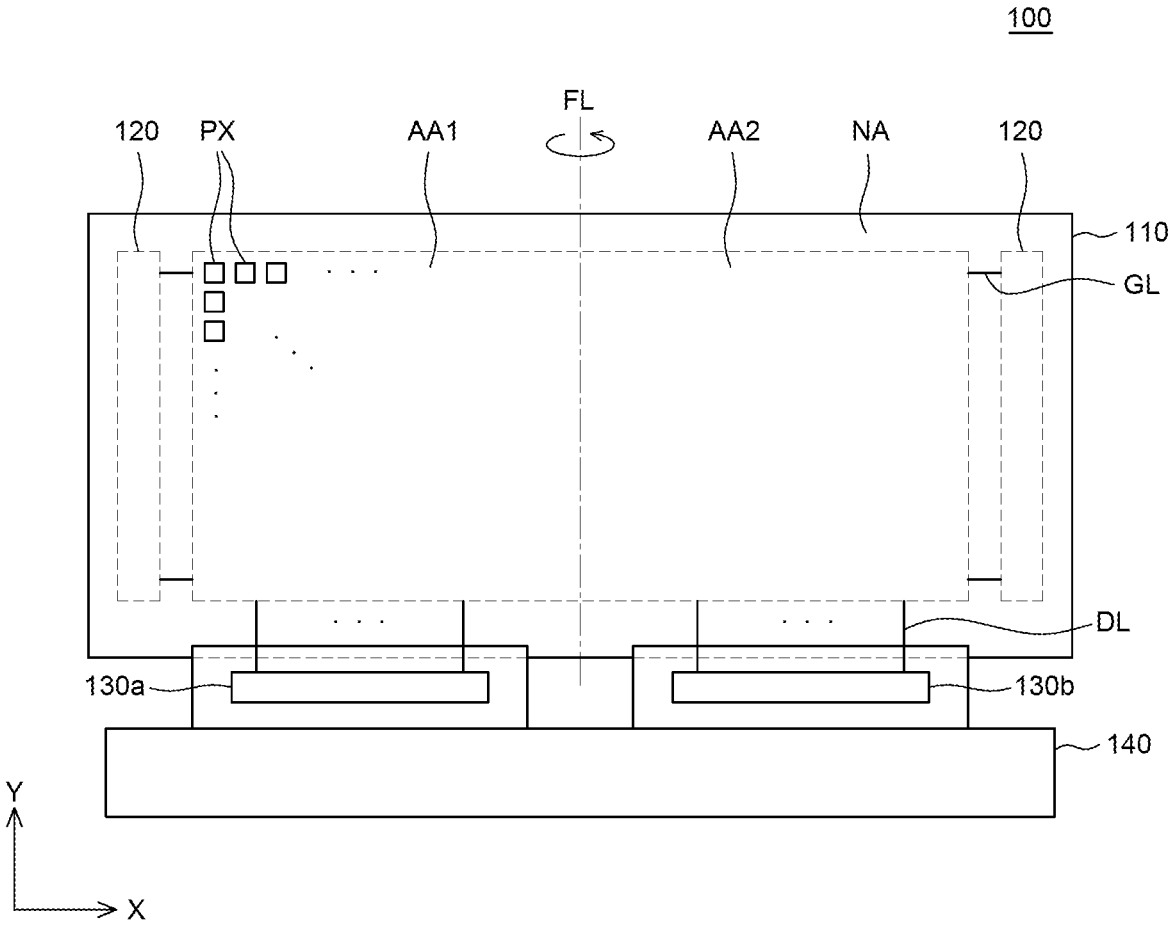
FIG. 1 is a schematic view for explaining a foldable display device according to an exemplary embodiment of the present disclosure.

Advantages and characteristics of the present disclosure and a method of achieving the advantages and characteristics will be clear by referring to exemplary embodiments described below in detail together with the accompanying drawings. However, the present disclosure is not limited to the exemplary embodiments disclosed herein but will be implemented in various forms. The exemplary embodiments are provided by way of example only so that those skilled in the art can fully understand the disclosures of the present disclosure and the scope of the present disclosure. Therefore, the present disclosure will be defined only by the scope of the appended claims.

The shapes, sizes, ratios, angles, numbers, and the like illustrated in the accompanying drawings for describing the exemplary embodiments of the present disclosure are merely examples, and the present disclosure is not limited thereto. Like reference numerals generally denote like elements throughout the specification. Further, in the following description of the present disclosure, a detailed explanation of known related technologies may be omitted to avoid unnecessarily obscuring the subject matter of the present disclosure. The terms such as "including," "having," and "consist of" used herein are generally intended to allow other components to be added unless the terms are used with the term "only". Any references to singular may include plural unless expressly stated otherwise.

Components are interpreted to include an ordinary error range even if not expressly stated.

When the position relation between two parts is described using the terms such as "on", "above", "below", and "next", one or more additional parts may be positioned between the two parts unless the terms are used with the term "immediately" or "directly".

When an element or layer is disposed "on" another element or layer, an additional layer or element may be interposed directly on the another element or therebetween.

Although the terms "first", "second", and the like are used for describing various components, these components are not confined by these terms. These terms are merely used for distinguishing one component from the other components. Therefore, a first component to be mentioned below may be a second component in a technical concept of the present disclosure.

A size and a thickness of each component illustrated in the drawing are illustrated for convenience of description, and the present disclosure is not limited to the size and the thickness of the component illustrated.

The features of various embodiments of the present disclosure can be partially or entirely adhered to or combined with each other and can be interlocked and operated in technically various ways, and the embodiments can be carried out independently of or in association with each other.

Hereinafter, a foldable display device according to exemplary embodiments of the present disclosure will be described in detail with reference to accompanying drawings.

FIG. 1 is a schematic view for explaining a foldable display device according to an exemplary embodiment of the present disclosure.

Referring to FIG. 1, a foldable display device 100 according to an exemplary embodiment of the present disclosure includes a display panel 110, a gate driving circuit 120, a data integrated circuit 130, and a printed circuit board 140.

On the display panel 110, a display area AA folded by at least one or more folding lines FL and a non-display area NA surrounding the display area AA are disposed.

In addition, the display area AA may be folded by the folding line FL. Accordingly, the display area may be divided into a first display area AA1 and a second display area AA2 by the folding line FL. That is, a boundary between the first display area AA1 and the second display area AA2 may be the folding line FL.

The display area AA may be divided into a folding area that is folded with a specific radius of curvature when folded, and non-folding areas that extend to both sides of the folding area and are maintained in a flat state. That is, the non-folding areas may be defined with the folding area therebetween.

Meanwhile, FIG. 1 illustrates that sizes of the first display area AA1 and the second display area AA2 are equal to each other, but embodiments of the present disclosure are not limited thereto. The sizes of the first display area AA1 and the second display area AA2 may be configured to be different from each other, as needed.

In the display area AA, a plurality of gate lines GL and a plurality of data lines DL are arranged to cross each other in a matrix form. In addition, a plurality of pixels PX may be defined by the plurality of gate lines GL and the plurality of the data lines DL. Each of the plurality of pixels PX includes at least one thin film transistor.

Each of the plurality of pixels PX may include a red sub-pixel that emits red light, a green sub-pixel that emits green light, and a blue sub-pixel that emits blue light, but the present disclosure is not limited thereto. Each of the plurality of pixels PX may include various colored sub-pixels.

In addition, in a case in which the foldable display device 100 according to an exemplary embodiment of the present disclosure is an organic light emitting display device, excitons are generated due to combination of electrons and holes emitted by applying a current to organic light emitting diodes provided in the plurality of pixels PX. In addition, the excitons emit light to implement gradation of the organic light emitting display device.

In this regard, the foldable display device 100 according to an exemplary embodiment of the present disclosure is not limited to an organic light emitting display device, and examples thereof may include various types of display device such as a liquid crystal display device, and the like.

Although not shown, touch electrodes for sensing a touch may be disposed in a matrix form on or inside the display panel 110 as needed in design. Accordingly, the foldable display device according to an exemplary embodiment of the present disclosure may sense a touch applied to the display panel 110 using the touch electrodes.

The touch sensing of the foldable display device 100 described above may be performed by a self-capacitive method of sensing self-capacitance of the touch electrode or by a mutual-capacitive method of sensing the touch through a change in mutual capacitance between a receiving touch electrode and a transmitting touch electrode.

The gate driving circuit 120 sequentially supplies a gate voltage to the gate lines GL.

The gate driving circuit 120 may be located, according to a driving method, only on one side of the display panel 110 or may be located on both sides of the display panel 110 in some cases. In addition, the gate driving circuit 120 may be implemented in a gate in panel (GIP) type and may be integrated in the display panel 110.

Specifically, in FIG. 1, the gate driving circuit 120 may be disposed on both sides of the display area AA based on an X-axis direction and extend in a Y-axis direction, on the display panel 110. In other words, since the folding line FL extends in the Y-axis direction, the gate driving circuit 120 may extend in a direction parallel to the folding line FL. However, the folding line FL only needs to be parallel to the gate driving circuit 120, but a position thereof is not limited to a central portion of the display panel 110.

Meanwhile, the gate driving circuit 120 may include a shift register, a level shifter, and the like.

Referring to FIG. 1, the data integrated circuit 130 supplies a data voltage to the plurality of pixels disposed in the display area through the data lines DL.

In addition, the data integrated circuit 130 may include a first data integrated circuit 130*a* and a second data integrated circuit 130*b* for driving the first display area AA1 and the second display area AA2, respectively.

Specifically, the first data integrated circuit 130*a* outputs a data voltage to the first display area AA1 through the data lines DL. The second data integrated circuit 130*b* outputs a data voltage to the second display area AA2 through the data lines DL.

The data integrated circuit 130 may be disposed on one side or both sides of the display panel 110 based on the Y-axis direction, and extend in the X-axis direction. In other words, since the folding line FL extends in the Y-axis direction, the data integrated circuit 130 may extend in a direction perpendicular to the folding line FL.

FIG. 1 illustrates that the data integrated circuit 130 is divided into only two the first data integrated circuit 130*a* and the second data integrated circuit 130*b*, but the data integrated circuit 130 may be divided into two or more data integrated circuits as needed in design.

Meanwhile, the data integrated circuit 130 is disposed on a base film formed of an insulating material. That is, in FIG. 1, the data integrated circuit 130 is illustrated as being mounted in the form of a COF (Chip ON Film), but is not limited thereto. The data integrated circuit 130 may be mounted in the form of a COG (Chip On Glass), TCP (Tape Carrier Package) or the like.

A controller such as an IC chip or a circuit unit may be mounted on the printed circuit board 140. In addition, a memory, a processor or the like may be mounted on the printed circuit board 140. The printed circuit board 140 is configured to transmit a signal for driving the display panel 110 from an external controller to the data integrated circuit 130.

Hereinafter, the data integrated circuit of the foldable display device according to an exemplary embodiment of the present disclosure will be described with reference to FIG. 2.

Figure 2:
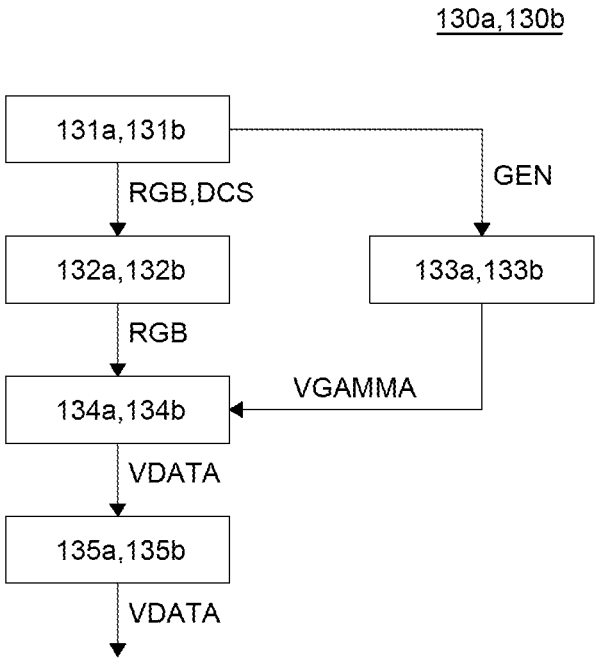
FIG. 2 is a block diagram for explaining data integrated circuits of the foldable display device according to an exemplary embodiment of the present disclosure.

FIG. 2 is a block diagram for explaining data integrated circuits of the foldable display device according to an exemplary embodiment of the present disclosure.

The first data integrated circuit 130*a* and the second data integrated circuit 130*b* may include timing controllers 131*a* and 131*b*, data processors 132*a* and 132*b*, gamma voltage generators 133*a* and 133*b*, digital analog converters (DAC) 134*a* and 134*b*, and output units 135*a* and 135*b*, respectively.

That is, the first data integrated circuit 130*a* may include a first timing controller 131*a*, a first data processor 132*a*, a first gamma voltage generator 133*a*, a first DAC 134*a*, and a first output unit 135*a*. The second data integrated circuit 130*b* may include a second timing controller 131*b*, a second data processor 132*b*, a second gamma voltage generator 133*b*, a second DAC 134*b*, and a second output unit 135*b*.

Hereinafter, for convenience of description, the first timing controller 131*a* and the second timing controller 131*b* are collectively described as the timing controllers 131*a* and 131*b*. The first data processor 132*a* and the second data processor 132*b* are collectively described as the data processors 132*a* and 132*b*. The first gamma voltage generator 133*a* and the second gamma voltage generator 133*b* are collectively described as the gamma voltage generators 133*a* and 133*b*. The first DAC 134*a* and the second DAC 134*b* are collectively described as the DACs 134*a* and 134*b*. The first output unit 135*a* and the second output unit 135*b* are collectively described as the output units 135*a* and 135*b*.

The timing controllers 131*a* and 131*b* convert, an image signal applied to an external host system, into a data signal format that can be processed by the data processors 132*a* and 132*b*, based on a timing signal, thereby generating image data RGB.

To this end, the timing controllers 131*a* and 131*b* receive various timing signals including a vertical synchronization signal (Vsync), a horizontal synchronization signal (Hsync), a data enable (DE) signal, and a reference clock signal (CLK), together with the image signal, from the external host system.

In addition, the timing controllers 131*a* and 131*b* supply data control signals DCS to the data processors 132*a* and 132*b* and supply gate control signals to the gate driving circuit 120.

Specifically, the timing controllers 131*a* and 131*b* may output various data control signals (DCS) including a source start pulse (SSP), a source sampling clock (SSC), a source output enable signal (SOE) and the like, in order to control the data processors 132*a* and 132*b*.

Here, the source start pulse controls a data sampling start timing of one or more data circuits constituting the data processors 132*a* and 132*b*. The source sampling clock is a clock signal that controls a sampling timing of data in each data circuit. The source output enable signal (SOE) controls an output timing of the data processors 132*a* and 132*b*.

In addition, the timing controllers 131*a* and 131*b* output various gate control signals (GCS) including a gate start pulse (GSP), a gate shift clock (GSC), a gate output enable signal (GOE) and the like, in order to control the gate driving circuit 120.

Here, the gate start pulse controls an operation start timing of one or more gate circuits constituting the gate driving circuit 120. The gate shift clock is a clock signal commonly input to the one or more gate circuits, and controls a shift timing of a scan signal (gate pulse). The gate output enable signal specifies timing information of the one or more gate circuits.

The data processors 132*a* and 132*b* convert the image data RGB received from the timing controllers 131*a* and 131*b* into image data RGB in digital form and output it.

In addition, the data processors 132*a* and 132*b* may include various circuits such as a shift register, a plurality of latch units and the like.

Specifically, in the data processors 132*a* and 132*b*, the shift register shifts sampling signals according to the source sampling clock SSC of the data control signal DCS. In addition, the shift register generates a carry signal when data exceeding the number of latches of latch units is supplied.

A plurality of latch units sample the image data RGB from the timing controllers 131*a* and 131*b* in response to the sampling signals sequentially input from the shift register, latch the image data RGB on a horizontal line by horizontal line basis, and then, simultaneously output the image data RGB of one horizontal line during a turn-on level period of the source output enable signal SOE.

The gamma voltage generators 133*a* and 133*b* subdivide a plurality of gamma reference voltages by the number of gradations that can be expressed by the number of bits of the image data RGB and generate a gamma voltage VGAMMA corresponding to each gradation.

The DACs 134*a* and 134*b* decode, the image data RGB in digital form, input from the data processors 132*a* and 132*b*, and output, the gamma voltage VGAMMA in analog form, corresponding to a gradation value of the image data RGB, as the data voltage VDATA.

The output units 135*a* and 135*b* include a plurality of buffers connected one-to-one to the data lines DL to minimize or reduce signal attenuation of the analog data voltage VDATA supplied from the DACs 134*a* and 134*b*.

Through a series of processes described above, each of the first data integrated circuit 130*a* and the second data integrated circuit 130*b* of the foldable display device 100 according to an exemplary embodiment of the present disclosure may output the data voltage VDATA to the plurality of data lines DL.

Hereinafter, a configuration of the first gamma voltage generator 133*a* of the first data integrated circuit 130*a* and a configuration of the second gamma voltage generator 133*b* of the second data integrated circuit 130*b* will be described in detail with reference to FIGS. 3 and 4.

Figure 3:
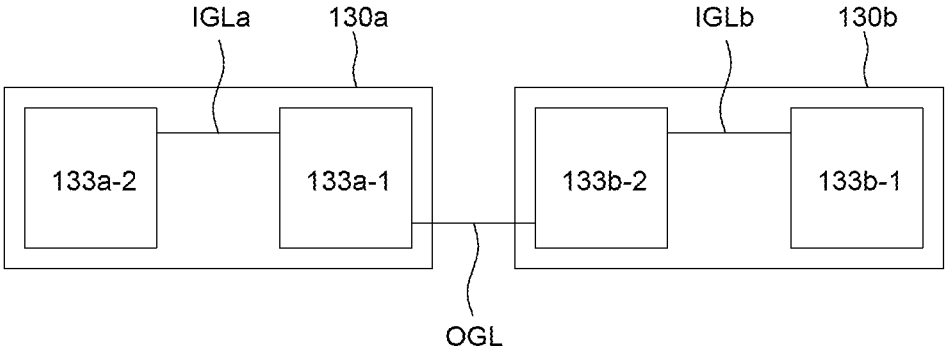
FIG. 3 is a block diagram for explaining gamma voltage units of data integrated circuits of the foldable display device according to an exemplary embodiment of the present disclosure.

FIG. 3 is a block diagram for explaining gamma voltage units of data integrated circuits of the foldable display device according to an exemplary embodiment of the present disclosure.

As shown in FIG. 3, the first gamma voltage generator 133*a* of the first data integrated circuit 130*a* includes a first main gamma voltage generator 133*a*-1 and a first sub-gamma voltage generator 133*a*-2, and the second gamma voltage generator 133*b* of the second data integrated circuit 130*b* includes a second main gamma voltage generator 133*b*-1 and a second sub-gamma voltage generator 133*b*-2.

Specifically, the first main gamma voltage generator 133*a*-1 and the first sub-gamma voltage generator 133*a*-2 are disposed on both sides of the first data integrated circuit 130*a* (e.g., opposite sides of the first data integrated circuit 130*a*), and the first main gamma voltage generator 133*a*-1 and the first sub-gamma voltage generator 133*a*-2 are connected to each other by a first internal gamma line IGLa. Accordingly, the first main gamma voltage generator 133*a*-1 and the first sub-gamma voltage generator 133*a*-2 both output a plurality of gamma voltages to the first internal gamma line IGLa and minimize or reduce a resistance drop of the plurality of gamma voltages applied to the first internal gamma line IGLa, thereby minimizing or reducing a deviation of the plurality of gamma voltages.

In addition, the second main gamma voltage generator 133*b*-1 and the second sub-gamma voltage generator 133*b*-2 are disposed on both sides of the second data integrated circuit 130*b* (e.g., opposite sides of the second data integrated circuit 130*b*), and the second main gamma voltage generator 133*b*-1 and the second sub-gamma voltage generator 133*b*-2 are connected to each other by a second internal gamma line IGLb. Accordingly, the second main gamma voltage generator 133*b*-1 and the second sub-gamma voltage generator 133*b*-2 both output a plurality of gamma voltages to the second internal gamma line IGLb and minimize or reduce a resistance drop of the plurality of gamma voltages applied to the second internal gamma line IGLb, thereby minimizing or reducing a deviation of the plurality of gamma voltages.

As described above, the first main gamma voltage generator 133*a*-1 is disposed on one side of the first data integrated circuit 130*a*, and the second sub-gamma voltage generator 133*b*-2 is disposed on the other side of the second data integrated circuit 130*b* to configured to be adjacent to the first main gamma voltage generator 133*a*-1. Thus, the first main gamma voltage generator 133*a*-1 and the second sub-gamma voltage generator 133*b*-2 may be disposed to configured to be adjacent to each other. Also, the first main gamma voltage generator 133*a*-1 and the second sub-gamma voltage generator 133*b*-2 may be connected to each other by an external gamma line OGL.

Figure 4:
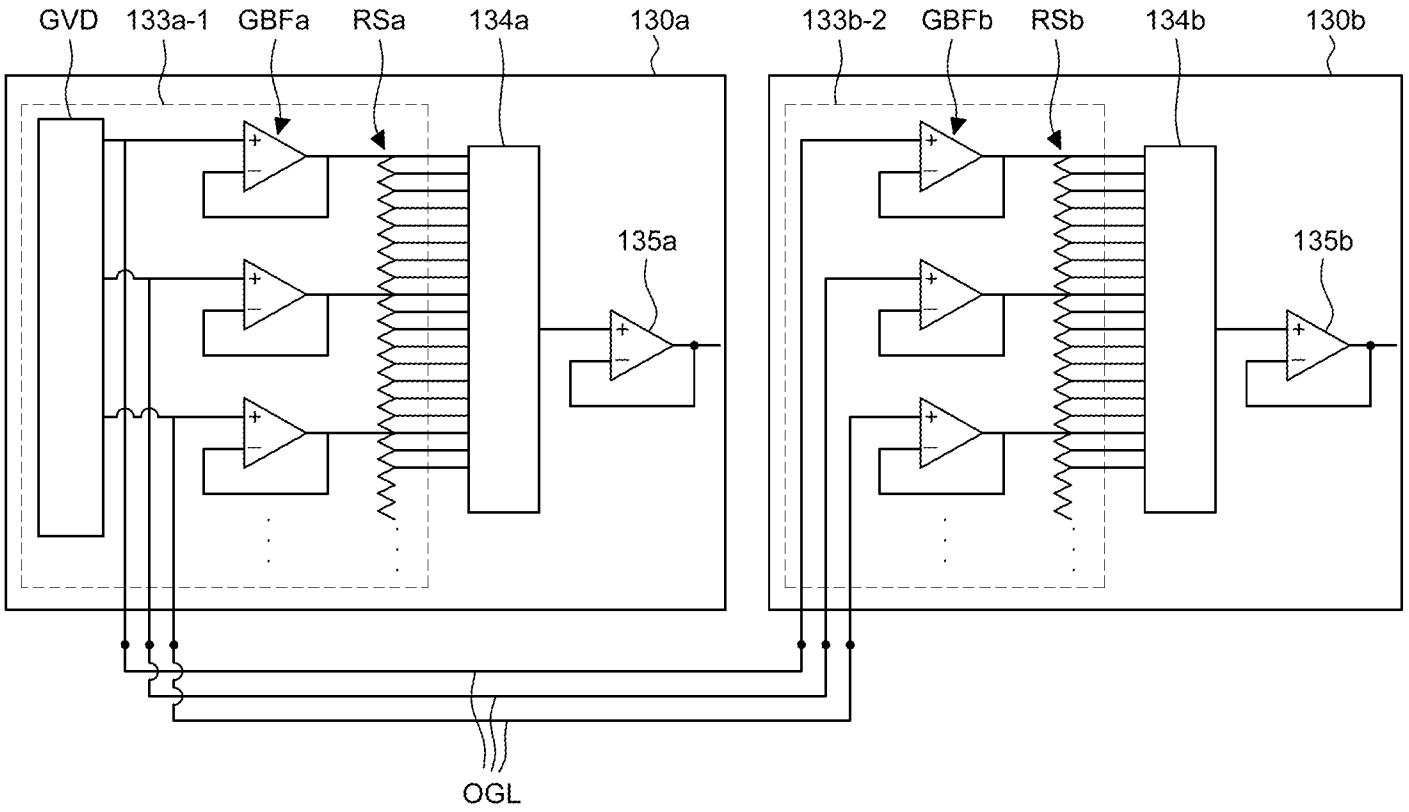
FIG. 4 is a circuit diagram for explaining gamma voltage units of data integrated circuits of the foldable display device according to an exemplary embodiment of the present disclosure.

FIG. 4 is a circuit diagram for explaining gamma voltage units of data integrated circuits of the foldable display device according to an exemplary embodiment of the present disclosure.

As illustrated in FIG. 4, the first main gamma voltage generator 133*a*-1 includes a gamma reference voltage divider GVD, first gamma output buffers GBFa, and first resistor strings RSa. Meanwhile, the second sub-gamma voltage generator 133*b*-2 includes second gamma output buffers GBFb and second resistor strings RSb. That is, only the first main gamma voltage generator 133*a*-1 includes the gamma reference voltage divider GVD, and the second sub-gamma voltage generator 133*b*-2 does not include the gamma reference voltage divider GVD.

In relation to the first main gamma voltage generator 133*a*-1, the gamma reference voltage divider GVD divides the gamma reference voltages and applies the divided gamma reference voltages to a plurality of the first gamma output buffers GBFa.

Specifically, the gamma reference voltage divider GVD may include a separate resistor string and a MUX circuit. The resistor string divides a low potential gamma reference voltage and a high potential gamma reference voltage into a plurality of gamma reference voltages. In addition, the MUX circuit may output only some of the plurality of gamma reference voltages to the first gamma output buffers GBFa.

However, the gamma reference voltage unit is not limited to have a structure described above, and may receive a gamma reference voltage applied from an external power supply unit and output it to the first gamma output buffers GBFa.

The plurality of first gamma output buffers GBFa are connected to the gamma reference voltage divider GVD to stably output the plurality of gamma reference voltages to a plurality of first resistor strings RSa.

Accordingly, the gamma reference voltage divider GVD is connected to each of input terminals of the plurality of first gamma output buffers GBFa, and the plurality of first resistor strings RSa are connected to output terminals of the plurality of first gamma output buffers GBFa, so that the divided gamma reference voltages may be output to the plurality of first resistor strings RSa.

In addition, the output terminals of the plurality of first gamma output buffers GBFa are connected to the input terminals of the plurality of first gamma output buffers GBFa, so that the plurality of gamma reference voltages may be fed back. Accordingly, the plurality of first gamma output buffers GBFa may stably output the gamma reference voltages.

Then, the plurality of first resistor strings RSa are connected to the plurality of first gamma output buffers GBFa to divide the plurality of gamma reference voltages into a plurality of gamma voltages.

Specifically, gamma voltages obtained by dividing the plurality of gamma reference voltages at different ratios may be applied to respective nodes disposed between the plurality of first resistor strings RSa. Accordingly, the respective nodes disposed between the plurality of first resistor strings RSa are connected to an input terminal of the first DAC 134*a*, whereby a plurality of gamma voltages obtained by dividing the plurality of gamma reference voltages at different ratios may be applied to the first DAC 134*a*.

The first DAC 134*a* outputs, as the data voltage VDATA, a gamma voltage in analog form, corresponding to the gradation value of the image data RGB, among the plurality of gamma voltages obtained by dividing the plurality of gamma reference voltages at different ratios, to the first output unit 135*a*.

Then, the first output unit 135*a* outputs the analog data voltage VDATA applied to an input terminal thereof to the data lines DL.

Next, in relation to the second sub-gamma voltage generator 133*b*-2, a plurality of the second gamma output buffers GBFb stably output the plurality of gamma reference voltages applied from the gamma reference voltage divider GVD of the first main gamma voltage generator 133*a*-1.

To this end, the each of input terminals of the plurality of first gamma output buffers GBFa are connected one-to-one to each of input terminals of the plurality of second gamma output buffers GBFb through a plurality of external gamma lines OGL. Accordingly, the each of input terminals of the plurality of second gamma output buffers GBFb are connected to the gamma reference voltage divider by the plurality of external gamma lines OGL to thereby output the divided gamma reference voltages.

Also, the each of input terminals of the plurality of second gamma output buffers GBFb are connected to output terminals of the second gamma output buffers GBFb, so that the plurality of gamma reference voltages may be fed back. Accordingly, the plurality of second gamma output buffers GBFb may stably output the gamma reference voltages.

Then, a plurality of the second resistor strings RSb are connected to the plurality of second gamma output buffers GBFb to divide the plurality of gamma reference voltages into a plurality of gamma voltages.

Specifically, gamma voltages obtained by dividing the plurality of gamma reference voltages at different ratios may be applied to respective nodes disposed between the plurality of second resistor strings RSb. Accordingly, the respective nodes disposed between the plurality of second resistor strings RSb are connected to an input terminal of the second DAC 134*b*, so that a plurality of the gamma voltages obtained by dividing the plurality of gamma reference voltages at different ratios may be applied to the second DAC 134*b*.

The second DAC 134*b* outputs, as the data voltage VDATA, a gamma voltage in analog form, corresponding to the gradation value of the image data RGB, among the plurality of gamma voltages obtained by dividing the plurality of gamma reference voltages at different ratios, to the second output unit 135*b*.

Then, the second output unit 135*b* outputs the analog data voltage VDATA applied to an input terminal thereof to the data lines DL.

As described above, in the foldable display device according to an exemplary embodiment of the present disclosure, the first main gamma voltage generator 133*a*-1 of the first data integrated circuit 130*a* and the second sub-gamma voltage generator 133*b*-2 of the second data integrated circuit 130*b* both receive the gamma reference voltages applied from a single gamma reference voltage divider GVD.

Accordingly, a deviation between the gamma voltage generated in the first data integrated circuit 130*a* and the gamma voltage generated in the second data integrated circuit 130*b* may be minimized or reduced.

Consequently, a deviation between the data voltage output from the first data integrated circuit 130*a* and the data voltage output from the second data integrated circuit 130*b* may be significantly reduced.

As a result, in the foldable display device according to an exemplary embodiment of the present disclosure, even when a plurality of display areas are driven using a plurality of data integrated circuits, a luminance deviation between the plurality of display areas may be reduced, thereby minimizing or reducing boundaries between the plurality of display areas.

Hereinafter, a foldable display device according to another exemplary embodiment of the present disclosure will be described with reference to FIGS. 5 and 6. Since the foldable display device according to an exemplary embodiment of the present disclosure and the foldable display device according to another exemplary embodiment of the present disclosure are different from each other only in terms of connection relationships of data integrated circuits and configurations of gamma voltage generators, descriptions will be made focusing on the differences.

Figure 5:
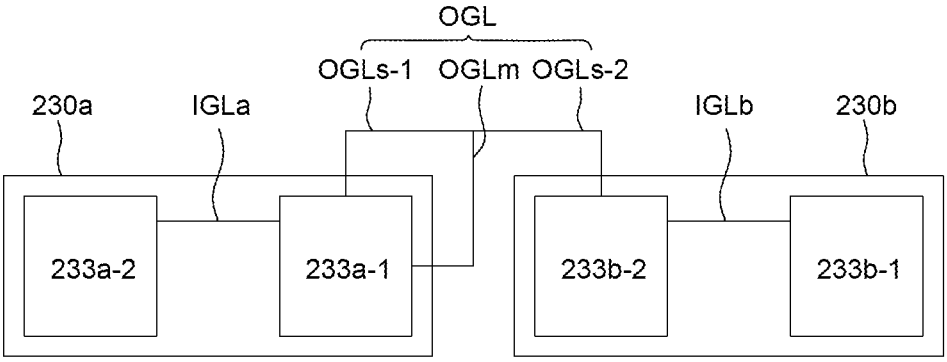
FIG. 5 is a block diagram for explaining gamma voltage units of data integrated circuits of a foldable display device according to another exemplary embodiment of the present disclosure.

FIG. 5 is a block diagram for explaining gamma voltage units of data integrated circuits of a foldable display device according to another exemplary embodiment of the present disclosure.

As illustrated in FIG. 5, a first gamma voltage generator 233*a* of a first data integrated circuit 230*a* includes a first main gamma voltage generator 233*a*-1 and a first sub-gamma voltage generator 233*a*-2. A second gamma voltage generator 233*b* of the second data integrated circuit 230*b* includes a second main gamma voltage generator 233*b*-1 and a second sub-gamma voltage generator 233*b*-2.

Specifically, the first main gamma voltage generator 233*a*-1 and the first sub-gamma voltage generator 233*a*-2 are disposed on both sides of the first data integrated circuit 230*a* (e.g., opposite sides of the first data integrated circuit 230*a*), and the first main gamma voltage generator 233*a*-1 and the first sub-gamma voltage generator 233*a*-2 are connected to each other by a first internal gamma line IGLa. Accordingly, the first main gamma voltage generator 233*a*-1 and the first sub-gamma voltage generator 233*a*-2 both output a plurality of gamma voltages to the first internal gamma line IGLa and minimize or reduce a resistance drop of the plurality of gamma voltages applied to the first internal gamma line IGLa, thereby minimizing or reducing a deviation of the plurality of gamma voltages.

In addition, the second main gamma voltage generator 233*b*-1 and the second sub-gamma voltage generator 233*b*-2 are disposed on both sides of the second data integrated circuit 230*b* (e.g., opposite sides of the second data integrated circuit 130*b*), and the second main gamma voltage generator 233*b*-1 and the second sub-gamma voltage generator 233*b*-2 are connected to each other by a second internal gamma line IGLb. Accordingly, the second main gamma voltage generator 233*b*-1 and the second sub-gamma voltage generator 233*b*-2 both output a plurality of gamma voltages to the second internal gamma line IGLb and minimize or reduce a resistance drop of the plurality of gamma voltages applied to the second internal gamma line IGLb, thereby minimizing or reducing a deviation of the plurality of gamma voltages.

As described above, the first main gamma voltage generator 233*a*-1 is disposed on one side of the first data integrated circuit 230*a*, and the second sub-gamma voltage generator 233*b*-2 is disposed on the other side of the second data integrated circuit 230*b* to configured to be adjacent to the first main gamma voltage generator 233*a*-1. Thus, the first main gamma voltage generator 233*a*-1 and the second sub-gamma voltage generator 233*b*-2 may be disposed to be adjacent to each other. In addition, the first main gamma voltage generator 233*a*-1 and the second sub-gamma voltage generator 233*b*-2 may be connected to each other by an external gamma line OGL.

The external gamma line OGL may include a main connection line OGLm and a first sub-connection line OGLs-1 and a second sub-connection line OGLs-2 that are branched from the main connection line OGLm.

The main connection line OGLm is connected to the first main gamma voltage generator 233*a*-1, and the first sub-connection line OGLs-1 and the second sub-connection line OGLs-2 may be branched from the main connection line OGLm. Further, lengths of the first sub-connection line OGLs-1 and the second sub-connection line OGLs-2 may be equal to each other. Accordingly, a line resistance of the first sub-connection line OGLs-1 and a line resistance of the second sub-connection line OGLs-2 may be equal to each other.

In addition, the first sub-connection line OGLs-1 may be connected to the first main gamma voltage generator 233*a*-1, and the second sub-connection line OGLs-2 may be connected to the second sub-gamma voltage generator 233*b*-2.

Figure 6:
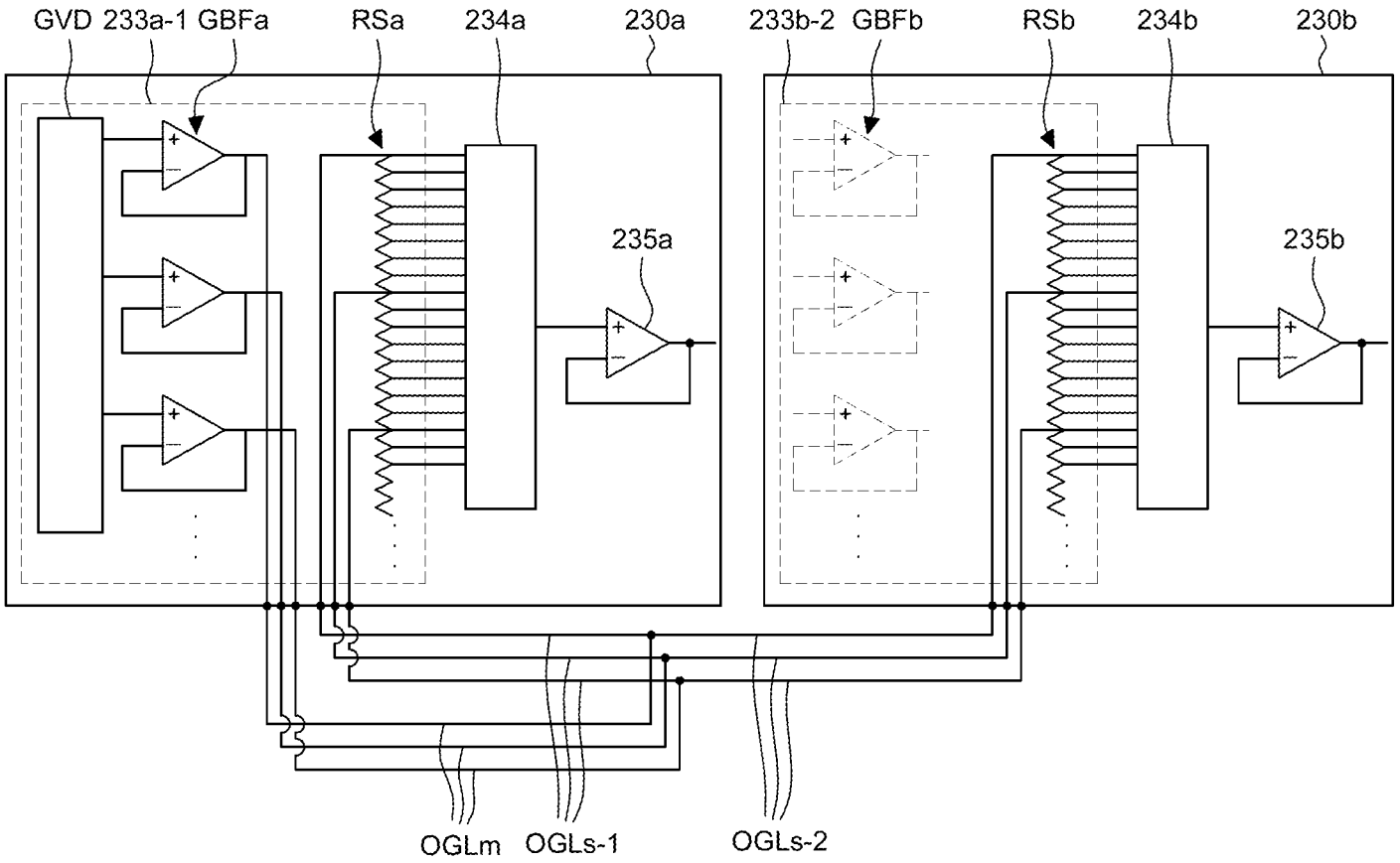
FIG. 6 is a circuit diagram for explaining gamma voltage units of data integrated circuits of the foldable display device according to another exemplary embodiment of the present disclosure.

FIG. 6 is a circuit diagram for explaining gamma voltage units of data integrated circuits of the foldable display device according to another exemplary embodiment of the present disclosure.

As shown in FIG. 6, the first main gamma voltage generator 233*a*-1 includes a gamma reference voltage divider GVD, first gamma output buffers GBFa, and first resistor strings RSa. Meanwhile, the second sub-gamma voltage generator 233*b*-2 includes second gamma output buffers GBFb and second resistor strings RSb. That is, only the first main gamma voltage generator 233*a*-1 includes the gamma reference voltage divider GVD, and the second sub-gamma voltage generator 233*b*-2 does not include the gamma reference voltage divider GVD.

In relation to the first main gamma voltage generator 233*a*-1, the gamma reference voltage divider GVD divides gamma reference voltages and applies the divided gamma reference voltages to a plurality of the first gamma output buffers GBFa.

Specifically, the gamma reference voltage divider GVD may include a separate resistor string and a MUX circuit. The resistor string divides a low potential gamma reference voltage and a high potential gamma reference voltage into a plurality of gamma reference voltages. In addition, the MUX circuit may output only some of the plurality of gamma reference voltages to the first gamma output buffers GBFa.

However, the gamma reference voltage unit is not limited to have a structure described above, and a gamma reference voltage may be applied from an external power supply unit and output to the first gamma output buffers GBFa.

The plurality of first gamma output buffers GBFa stably output the plurality of gamma reference voltages to a plurality of main connection lines OGLm.

Accordingly, the gamma reference voltage divider GVD is connected to each of input terminals of the plurality of first gamma output buffers GBFa, and the plurality of main connection lines OGLm are connected to output terminals of the plurality of first gamma output buffers GBFa, so that the divided gamma reference voltages may be output to the plurality of main connection lines OGLm.

In addition, the output terminals of the plurality of first gamma output buffers GBFa are connected to the input terminals of the plurality of first gamma output buffers GBFa, so that the plurality of gamma reference voltages may be fed back. Accordingly, the plurality of first gamma output buffers GBFa may stably output the gamma reference voltages.

Further, the plurality of main connection lines OGLm may be connected to a plurality of first sub-connection lines OGLs-1, and the plurality of first sub-connection lines OGLs-1 may be connected to a plurality of the first resistor strings RSa.

In other words, the plurality of first resistor strings RSa may be connected to the plurality of first gamma output buffers GBFa by the plurality of main connection lines OGLm and the plurality of first sub-connection lines OGLs-1.

Accordingly, the gamma reference voltages divided by the gamma reference voltage divider GVD may be applied to the plurality of first resistor strings RSa through the plurality of main connection lines OGLm and the plurality of first sub-connection lines OGLs-1.

In addition, the plurality of first resistor strings RSa divides the plurality of gamma reference voltages applied through the plurality of main connection lines OGLm and the plurality of first sub-connection lines OGLs-1 into a plurality of gamma voltages.

Specifically, gamma voltages obtained by dividing the plurality of gamma reference voltages at different ratios may be applied to respective nodes disposed between the plurality of first resistor strings RSa. Accordingly, the respective nodes disposed between the plurality of first resistor strings RSa are connected to an input terminal of a first DAC 234*a*, whereby a plurality of gamma voltages obtained by dividing the plurality of gamma reference voltages at different ratios may be applied to the first DAC 234*a*.

The first DAC 234*a* outputs, as the data voltage VDATA, a gamma voltage in analog form, corresponding to the gradation value of the image data RGB, among the plurality of gamma voltages obtained by dividing the plurality of gamma reference voltages at different ratios, to a first output unit 235*a*.

Then, the first output unit 235*a* outputs the analog data voltage VDATA applied to an input terminal thereof to the data lines DL.

Next, in relation to the second sub-gamma voltage generator 233*b*-2, the plurality of main connection lines OGLm may be connected to a plurality of second sub-connection lines OGLs-2, and the plurality of second sub-connection lines OGLs-2 may be connected to a plurality of the second resistor strings RSb.

In other words, the plurality of second resistor strings RSb may be connected to the plurality of first gamma output buffers GBFa by the plurality of main connection lines OGLm and the plurality of second sub-connection lines OGLs-2.

Accordingly, the gamma reference voltages divided by the gamma reference voltage divider GVD may be applied to the plurality of second resistor strings RSb through the plurality of main connection lines OGLm and the plurality of second sub-connection lines OGLs-2.

In addition, the plurality of second resistor strings RSb divide the plurality of gamma reference voltages applied through the plurality of main connection lines OGLm and the plurality of second sub-connection lines OGLs-2 into a plurality of gamma voltages.

Specifically, gamma voltages obtained by dividing the plurality of gamma reference voltages at different ratios may be applied to respective nodes disposed between the plurality of second resistor strings RSb. Accordingly, the respective nodes disposed between the plurality of second resistor strings RSb are connected to an input terminal of a second DAC 234*b*, whereby a plurality of gamma voltages obtained by dividing the plurality of gamma reference voltages at different ratios may be applied to the second DAC 234*b*.

The second DAC 234*b* outputs, as the data voltage VDATA, a gamma voltage in analog form, corresponding to the gradation value of the image data RGB, among the plurality of gamma voltages obtained by dividing the plurality of gamma reference voltages at different ratios, to a second output unit 235*b*.

Then, the second output unit 235*b* outputs the analog data voltage VDATA applied to an input terminal thereof to the data lines DL.

However, in another exemplary embodiment of the present disclosure, the second gamma output buffers GBFb of the second sub-gamma voltage generator 233*b*-2 are unnecessary in a process of generating the gamma voltages. Accordingly, the second gamma output buffers GBFb may be in an off state all the time.

Specifically, the second gamma output buffers GBFb may be maintained in an off state by blocking the supply of a driving voltage supplied to a power source terminal of the second gamma output buffers GBFb, but the present disclosure is not limited thereto. The second sub-gamma voltage generator 233*b*-2 may not include the second gamma output buffers GBFb.

As described above, in the foldable display device according to another exemplary embodiment of the present disclosure, the first main gamma voltage generator 233*a*-1 of the first data integrated circuit 230*a* and the second sub-gamma voltage generator 233*b*-2 of the second data integrated circuit 230*b* both receive the gamma reference voltages from a single gamma reference voltage divider GVD.

In addition, in the foldable display device according to another exemplary embodiment of the present disclosure, resistances of the first sub-connection line OGLs-1 and the second sub-connection line OGLs-2 branched from the main connection line OGLm are equal to each other, so that a resistance drop of the gamma reference voltage supplied to the first main gamma voltage generator 233*a*-1 and a resistance drop of the gamma reference voltage supplied to the second sub-gamma voltage generator 233*b*-2 may be equal to each other.

Accordingly, a deviation between the gamma voltage generated in the first data integrated circuit 230*a* and the gamma voltage generated in the second data integrated circuit 230*b* may be minimized or reduced.

Consequently, a deviation between the data voltage output from the first data integrated circuit 230*a* and the data voltage output from the second data integrated circuit 230*b* may be significantly reduced.

As a result, in the foldable display device according to another exemplary embodiment of the present disclosure, even when a plurality of display areas are driven using a plurality of data integrated circuits, a luminance deviation between the plurality of display areas may be reduced, thereby minimizing or reducing boundaries between the plurality of display areas.

The exemplary embodiments of the present disclosure can also be described as follows.

According to an aspect of the present disclosure, a foldable display device includes a display panel including a plurality of display areas divided by at least one or more folding lines; and a plurality of data integrated circuits outputting a data voltage to the plurality of display areas respectively, wherein each of the plurality of data integrated circuits includes at least one or more gamma voltage generators outputting a plurality of gamma voltages, wherein the at least one or more gamma voltage generators are connected by an external gamma line, so that boundaries between the display areas may be minimized or reduced.

The display panel may include a first display area and a second display area and the plurality of data integrated circuits may include a first data integrated circuit for driving the first display area and a second data integrated circuit for driving the second display area.

The first data integrated circuit may include a first digital analog converter (DAC) outputting some of the plurality of gamma voltages as the data voltage, and a first output unit outputting the data voltage to a data line disposed in the first display area, and, the second data integrated circuit includes, a second DAC outputting some of the plurality of gamma voltages as the data voltage and a second output unit outputting the data voltage to a data line disposed in the second display area.

The first data integrated circuit may include a first main gamma voltage generator and a first sub-gamma voltage generator that generate the plurality of gamma voltages, and the second data integrated circuit includes, a second main gamma voltage generator and a second sub-gamma voltage generator that generate the plurality of gamma voltages.

The first main gamma voltage generator and the second sub-gamma voltage generator may be connected to each other by the external gamma line.

The first main gamma voltage generator and the first sub-gamma voltage generator may be connected to each other by a first internal gamma line, and the second main gamma voltage generator and the second sub-gamma voltage generator are connected to each other by a second internal gamma line.

The first main gamma voltage generator may be disposed on one side of the first data integrated circuit, and the second sub-gamma voltage generator is disposed on the other side of the second data integrated circuit configured to be adjacent to the first main gamma voltage generator.

The first main gamma voltage generator may include, a gamma reference voltage divider outputting a gamma reference voltage; a plurality of first gamma output buffers connected to the gamma reference voltage divider; and a plurality of first resistor strings connected to the plurality of first gamma output buffers, and the second sub-gamma voltage generator includes, a plurality of second gamma output buffers connected to the gamma reference voltage divider through the plurality of external gamma lines; and a plurality of second resistor strings connected to the plurality of second gamma output buffers.

Each of input terminals of the plurality of first gamma output buffers may be connected one-to-one to each of input terminals of the plurality of second gamma output buffers by the plurality of external gamma lines.

Each of the plurality of external gamma lines may include, a main connection line, and a first sub-connection line and a second sub-connection line that are branched from the main connection line.

A line resistance of the first sub-connection line and a line resistance of the second sub-connection line are equal to each other.

The first main gamma voltage generator may include a gamma reference voltage divider outputting a gamma reference voltage; a plurality of first gamma output buffers connected to the gamma reference voltage divider; and a plurality of first resistor strings connected to the plurality of first gamma output buffers by the plurality of main connection lines and the plurality of first sub-connection lines, and the second sub-gamma voltage generator may include, a plurality of second resistor strings connected to the plurality of first gamma output buffers by the plurality of main connection lines and the plurality of second sub-connection lines.

Although the exemplary embodiments of the present disclosure have been described in detail with reference to the accompanying drawings, the present disclosure is not limited thereto and may be embodied in many different forms without departing from the technical concept of the present disclosure. Therefore, the exemplary embodiments of the present disclosure are provided for illustrative purposes only but not intended to limit the technical concept of the present disclosure. The scope of the technical concept of the present disclosure is not limited thereto. Therefore, it should be understood that the above-described exemplary embodiments are illustrative in all aspects and do not limit the present disclosure. The protective scope of the present disclosure should be construed based on the following claims, and all the technical concepts in the equivalent scope thereof should be construed as falling within the scope of the present disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A foldable display device, comprising:

a display panel including a plurality of display areas divided by at least one or more folding lines; and a plurality of data integrated circuits, each of the data integrated circuits configured to output a data voltage to a respective display area of the plurality of display areas, the plurality of data integrated circuits including:

a first data integrated circuit including a first main gamma voltage generator and a first sub-gamma voltage generator, the first main gamma voltage generator including a gamma reference voltage divider configured to divide gamma reference voltages; and a second data integrated circuit including a second main gamma voltage generator and a second sub-gamma voltage generator, the first main gamma voltage generator and the second sub-gamma voltage generator being disposed adjacent to one another at opposite sides of one of the at least one or more folding lines, wherein each of the plurality of data integrated circuits is configured to output a plurality of gamma voltages based on an output of the gamma reference voltage divider, and wherein the first main gamma voltage generator in the first data integrated circuit is connected to the second sub-gamma voltage generator in the second data integrated circuit by an external gamma line that extends across the one of the at least one or more folding lines.

2. The foldable display device of claim 1, wherein the display panel includes a first display area and a second display area, wherein the first data integrated circuit is configured to drive the first display area; and wherein the second data integrated circuit is configured to drive the second display area.

3. The foldable display device of claim 2, wherein the first data integrated circuit includes:

a first digital analog converter (DAC) configured to output the plurality of gamma voltages as the data voltage for the first display area; and a first output unit configured to output the data voltage for the first display area to a data line disposed in the first display area, and the second data integrated circuit includes:

a second DAC configured to output the plurality of gamma voltages as the data voltage for the second display area; and a second output unit configured to output the data voltage for the second display area to a data line disposed in the second display area.

4. The foldable display device of claim 2, wherein the first main gamma voltage generator and the first sub-gamma voltage generator generate the plurality of gamma voltages for the first display area, and wherein the second main gamma voltage generator and the second sub-gamma voltage generator generate the plurality of gamma voltages for the second display area.

5. The foldable display device of claim 4, wherein the first main gamma voltage generator and the first sub-gamma voltage generator are connected to each other by a first internal gamma line, and the second main gamma voltage generator and the second sub-gamma voltage generator are connected to each other by a second internal gamma line.

6. The foldable display device of claim 4, wherein the first main gamma voltage generator is disposed on a first side of the first data integrated circuit, and the second sub-gamma voltage generator is disposed on a second side of the second data integrated circuit, the first side of the first data integrated circuit and the second side of the second data integrated circuit being adjacent to each other.

7. The foldable display device of claim 4, wherein the first main gamma voltage generator includes:

a plurality of first gamma output buffers connected to the gamma reference voltage divider; and a plurality of first resistor strings connected to the plurality of first gamma output buffers, and the second sub-gamma voltage generator includes:

a plurality of second gamma output buffers connected to the gamma reference voltage divider by the external gamma line including a plurality of external gamma lines; and a plurality of second resistor strings connected to the plurality of second gamma output buffers.

8. The foldable display device of claim 7, wherein each of input terminals of the plurality of first gamma output buffers is connected one-to-one to each of input terminals of the plurality of second gamma output buffers by the plurality of external gamma lines.

9. The foldable display device of claim 4, wherein each of the plurality of external gamma lines includes a main connection line, and a first sub-connection line and a second sub-connection line that are branched from the main connection line.

10. The foldable display device of claim 9, wherein a line resistance of the first sub-connection line and a line resistance of the second sub-connection line are equal to each other.

11. The foldable display device of claim 10, wherein the first main gamma voltage generator includes:

a plurality of first gamma output buffers connected to the gamma reference voltage divider; and a plurality of first resistor strings connected to the plurality of first gamma output buffers by a plurality of the main connection lines and a plurality of the first sub-connection lines, and the second sub-gamma voltage generator includes:

a plurality of second resistor strings connected to the plurality of first gamma output buffers by the plurality of the main connection lines and the plurality of the second sub-connection lines.

12. The foldable display device of claim 1, further comprising touch electrodes for sensing a touch disposed in a matrix form on or inside the display panel.

13. A foldable display device, comprising:

a display panel including a plurality of display areas divided by at least one or more folding lines; and a plurality of data integrated circuits, in operation, outputting a data voltage to the plurality of display areas respectively, the plurality of data integrated circuits including:

a first main gamma voltage generator on a first side of a first folding line of the at least one or more folding lines, the first main gamma voltage generator, in operation, outputting a first gamma voltage;

a second sub-gamma voltage generator on a second side of the first folding line, the second sub-gamma voltage generator, in operation, outputting a second gamma voltage, the first main gamma voltage generator and the second sub-gamma voltage generator being adjacent to each other and connected to each other by an external gamma line that extends across the first folding line;

wherein the first main gamma voltage generator and the second sub-gamma voltage generator share a same gamma reference voltage divider, the same gamma reference voltage divider, in operation, outputting a gamma reference voltage.

14. The foldable display device of claim 13, wherein the display panel includes a first display area and a second display area, wherein the first main gamma voltage generator is configured to drive the first display area; and wherein the second sub-gamma voltage generator is configured to drive the second display area.

15. The foldable display device of claim 14, wherein the plurality of data integrated circuits includes:

a first data integrated circuit including:

a first digital analog converter (DAC) configured to output the first gamma voltage as the data voltage for the first display area; and a first output unit configured to output the data voltage for the first display area to a data line disposed in the first display area, and a second data integrated circuit including:

a second DAC configured to output the second gamma voltage as the data voltage for the second display area; and a second output unit configured to output the data voltage for the second display area to a data line disposed in the second display area.

16. The foldable display device of claim 15, wherein the first main gamma voltage generator and a first sub-gamma voltage generator are connected to each other by a first internal gamma line, and a second main gamma voltage generator and the second sub-gamma voltage generator are connected to each other by a second internal gamma line.

17. The foldable display device of claim 16, wherein the first main gamma voltage generator is disposed on a first side of the first data integrated circuit, and the second sub-gamma voltage generator is disposed on a second side of the second data integrated circuit, the first side of the first data integrated circuit and the second side of the second data integrated circuit being adjacent to each other.

18. A method, comprising:

generating a gamma reference voltage by a gamma reference voltage divider of first main gamma voltage generator of a first data integrated circuit, the first data integrated circuit being positioned on a first side of a folding line of a foldable display panel;

generating a first gamma voltage by the first main gamma voltage generator of the first data integrated circuit, the first gamma voltage being based on the gamma reference voltage;

generating a second gamma voltage by a second sub-gamma voltage generator of a second data integrated circuit, the second data integrated circuit being positioned on a second side of the folding line opposite the first side, the second gamma voltage being based on the gamma reference voltage, the gamma reference voltage being received by the second sub-gamma voltage generator through an external gamma line that extends across the folding line and connects the first main gamma voltage generator to the second sub-gamma voltage generator;

driving a first display area of the foldable display panel based on the first gamma voltage; and driving a second display area of the foldable display panel based on the second gamma voltage.

19. The method of claim 18, wherein the first main gamma voltage generator is disposed on a first side of the first data integrated circuit, and the second sub-gamma voltage generator is disposed on a second side of the second data integrated circuit, the first side of the first data integrated circuit and the second side of the second data integrated circuit being adjacent to each other.

* * * * *